United States Patent [19]

Graveman et al.

[11] 4,149,677

[45] Apr. 17, 1979

[54] REINFORCED RING HAMMER

[75] Inventors: Donald F. Graveman, St. Charles; Donald G. Miller, Kirkwood, both of Mo.

[73] Assignee: American Pulverizer Company, St. Louis, Mo.

[21] Appl. No.: 850,944

[22] Filed: Nov. 14, 1977

[51] Int. Cl.[2] ..... B02C 13/28

[52] U.S. Cl. ..... 241/189 R; 241/196

[58] Field of Search ..... 241/188 R, 189 R, 189 A, 241/193, 196

[56] References Cited

U.S. PATENT DOCUMENTS

| | | | |
|---|---|---|---|
| 1,490,368 | 4/1924 | Elzemeyer | 241/196 X |
| 1,606,987 | 9/1926 | Maher | 241/196 |
| 1,733,637 | 10/1929 | Williams et al. | 241/196 |
| 3,580,518 | 5/1971 | Strom | 241/193 |
| 3,934,826 | 1/1976 | Graveman | 241/189 R X |

*Primary Examiner*—Howard N. Goldberg

*Attorney, Agent, or Firm*—Gravely, Lieder & Woodruff

[57] ABSTRACT

A ring hammer for a reducing machine includes an annular body and tooth projected radially from the annular body and arranged in two rows, with the teeth of the one row being spaced axially from the teeth of the other row and further being offset circumferentially from the teeth of the other row. A reinforcing ring extends around the annular body in the space between the two rows of teeth and is formed integral with the annular body and the teeth of the two rows. The reinforcing ring tapers downwardly to the side faces of the annular body in the spaces between successive teeth of each row so that the teeth possess greater depth at their outside faces than at their inside faces. The reinforcing ring strengthens the ring hammer and renders the teeth less susceptible to breakage.

18 Claims, 5 Drawing Figures

FIG. 1
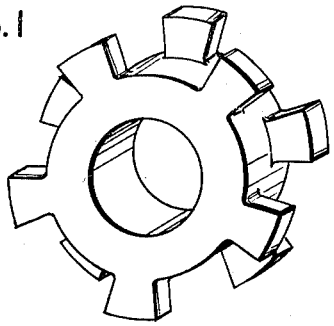
PRIOR ART
FIG. 2
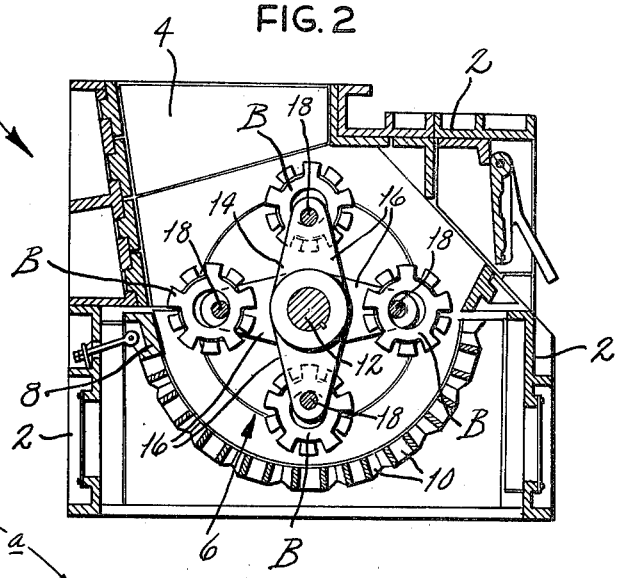
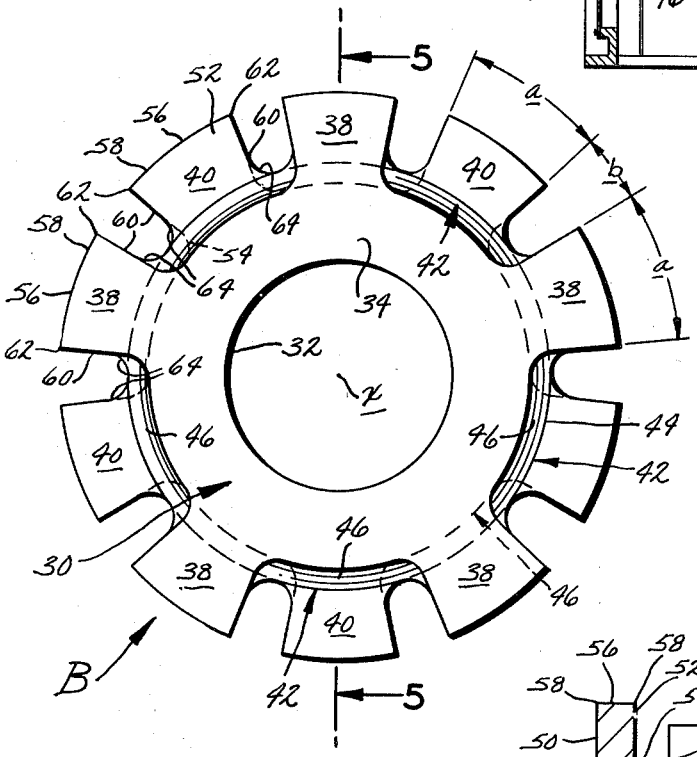
FIG. 3
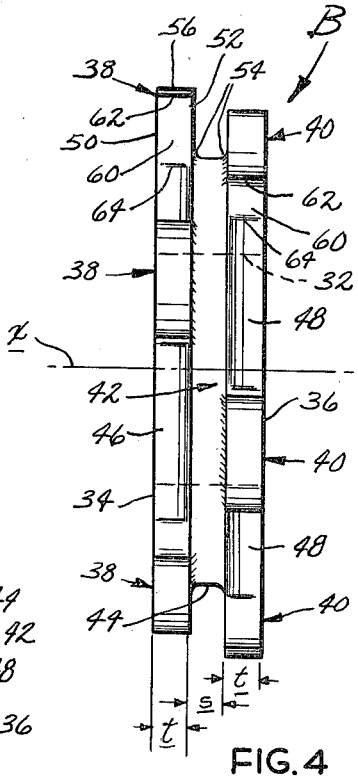
FIG. 4
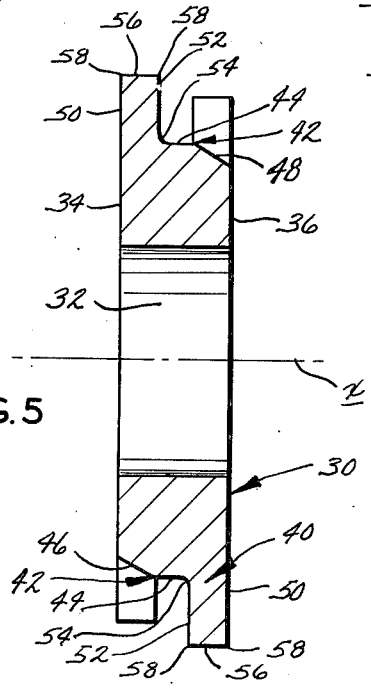
FIG. 5

REINFORCED RING HAMMER

BACKGROUND OF THE INVENTION

This invention relates in general to machines for reducing materials and more particularly to ring hammers for such machines.

Most pulverizing, crushing, and shredding machines have massive rotors provided with hammers which impact against material introduced into the machine and reduce that material to a smaller size. In some machines the hammers are elongated bodies that pivot relative to the rotor at their inner ends and have enlarged heads at their outer ends for striking the material to be reduced. Other machines utilize rings that fit loosely around hammer pins on the rotor. The ring hammers are free to rotate relative to the rotor, and continually present different edges toward the material. Thus, they last considerably longer than swing hammers.

Ring hammers are manufactured in various configurations, with the specific configuration depending to a large measure on the nature of material that is to be reduced and the consistency that is desired in the final product. For example, where pulverizing to a high percentage of fines is desired, a plain ring should be used. On the other hand where cutting or shredding is desired, the ring hammers sould have teeth projected radially from them. Indeed, in certain instances it is desirable to have the teeth arranged in two circumferential rows to present as large a number of cutting edges as possible consistent with maintaining adequate strength (FIG. 1). Ring hammers of this configuration are ideally suited for reducing metal turnings to smaller sizes which are more easily shipped and for reducing lump coal to a size more suitable for use in stoker fed boilers and the like since few fines are produced. However, as the number of teeth increases, the teeth themselves become weaker and are more easily broken. Increasing the length of the teeth produces the same problem.

SUMMARY OF THE INVENTION

One of the principal objects of the present invention is to provide a ring hammer having teeth arranged in a plurality of rows with the teeth being reinforced and less susceptible to breakage. Another object is to provide a ring hammer of the type stated in which the teeth are reinforced by a ring that is interposed between the rows of teeth. A further object is to produce a ring hammer of the type stated which has as many cutting edges as present double row ring hammers, yet is much less susceptible to breakage. An additional object is to provide a ring hammer of the type stated in which the effective length of the teeth is as great as conventional ring hammers, yet the teeth are substantially stronger and less susceptible to breakage. Still another object is to provide a material reducing machine having ring hammers of the present invention. These and other objects and advantages will become apparent hereinafter.

The present invention is embodied in a material reducing machine having an improved ring hammer, as well as in the ring hammer itself, and that ring hammer includes an annular body, teeth projected radially from the body and arranged in at least two rows, and a reinforcing ring extended completely around the annular body in the space between the two rows of teeth. The invention also consists in the parts and in the arrangements and combinations of parts hereinafter described and claimed.

DESCRIPTION OF THE DRAWING

In the accompanying drawing which forms part of the specification and wherein like numerals and letters refer to like parts wherever they occur.

FIG. 1 is a perspective view of a ring hammer constructed in accordance with the teachings of the prior art;

FIG. 2 is a sectional view of a reducing machine having ring hammers constructed in accordance with the present invention;

FIG. 3 is a side elevational view of the ring hammer of the present invention;

FIG. 4 is an end elevational view of the ring hammer; and

FIG. 5 is a sectional view taken along line 5—5 of FIG. 3.

DETAILED DESCRIPTION

Referring now to the drawing (FIG. 2), A designates a reducing machine which may be used to reduce coal, rock, metal turnings, or any number of materials to a smaller size. Basically the machine A includes a housing 2 having an inlet 4 leading into the interior thereof, a rotor 6 which carries ring hammers B that move past the inlet 4, a grinding plate 8 at the base of the inlet 4, and grate bars 10 arranged in an arc beyond the grinding plate 8 with the arc being concentric to the circle described by the hammers B on the rotor 6. Actually, the rotor 6 revolves on a rotor shaft 12 which is carried in large bearings mounted on the housing 2. Positioned along the rotor shaft 12 are spiders 14 each of which has arms 16 that radiate from the shaft 12 with the several arms 16 being spaced at equal angular intervals, normally 90°. While the centers of the spiders 14 abut along the shaft 12, the ends of the arms 16 of adjacent spiders 14 are spaced axially from each other, although they are aligned in the axial direction. Consequently, a space exists between each spider arm 16 and the corresponding arm 16 of the adjacent spiders 14. The ring hammers B occupy the spaces between the arms 16 of adjacent spiders 14 and are retained in place by hammer pins 18 which extend through the spider arms 16 as well as through the rings B themselves. The hammer pins 18 are parallel to the rotor shaft 12 and are normally spaced equally from that shaft. The hammers B are unitary structures made from a very tough and durable substance. Preferably they are cast from manganese steel.

Each ring hammer B includes (FIGS. 3-5) an annular body 30 that is concentric about a center axis X and has a center bore 32 and parallel side faces 34 and 36. The center bore 32 is cylindrical in configuration, with the axis of the bore 32 being the center axis X, and extends from one side face 34 to the other side face 36. Moreover, the bore 32 is substantially larger in diameter than the hammer pins 18 so that the ring hammer B fits loosely on its hammer pin 18 and can retract toward the rotor shaft 12 if it encounters an obstruction. The side faces 34 and 36 lie in planes that are perpendicular to the axis X, and constitute the lateral extremeties of the body 30. The spacing between the side faces 34 and 36, which is actually the width of the hammer B, is slightly less than the spacing between corresponding arms 16 on adjacent spiders 14, so that rings B fit loosely into the spaces between the spider arms 16 on the rotor 6.

Directed outwardly from the annular body 30 are radial teeth 38 and 40 which are arranged in two circumferential rows, with the teeth 38 being in one row and the teeth 40 being in the other row. Moreover, the teeth 38 of the one row are spaced from the teeth 40 of the other row by a distance s (FIG. 4) and at their inner ends merge into a reinforcing ring 42 which extends completely around the annular body 30, thereby occupying the space between the teeth 38 and 40 of the two rows. Not only are the teeth 38 and 40 of the two rows spaced axially from each other, but they are also offset from each other in the circumferential direction so that a discernible spacing in the circumferential direction exists between the alternating teeth 38 and 40. Thus, each tooth 38 and each tooth 40 stands alone along the periphery of the annular body 30 so as to be completely exposed along both of its sides. In other words, the teeth 38 and 40 are arranged individually around the annular body 30 and not side-by-side. The reinforcing ring 42 has an outwardly presented surface 44 that is continuous around the ring 30, and along the sides of the surface 44 it further has alternating beveled surfaces 46 and 48 which taper down to and intersect with the side faces 34 and 36, respectively along arcuate side edges that are concentric to the center axis X of the annular body 30. Hence, the beveled surfaces 46 are located between and separate the teeth 38 of the one row, while the beveled surfaces 48 are located between and separate the teeth 40 of the other row.

The teeth 38 and 40 are identical in configuration, but differ as to orientation. More specifically, each tooth 38 includes a planar outside face 50 which is actually a continuation of the side face 34 on the body 30. It also includes a planar inside face 52 which is parallel to the outside face 50 and merges into the outwardly directed surface 44 of the reinforcing ring 42 along a fillet 54 (FIGS. 4 & 5). Thus, the spacing between the two faces 50 and 52 represents the thickness t of the tooth 38. The two faces 50 and 52 intersect an arcuate outer face 56 along circumferential cutting edges 58, and the outer face 56 is concentric about the axis X. Indeed, the arcuate outer faces 56 of all of the teeth 38, as well as the teeth 40, lie in or define a cylinder that has its center at the axis X. Completing the tooth 38 are end faces 60 which intersect the arcuate outer face 56 at transverse cutting edges 62. The end faces 60 lie along radii emanating from the axis X and merge into the beveled faces 46 of the reinforcing ring 42 at fillets 64. Being along radii for the annular body 30, the end faces delineate an included angle a (FIG. 3) along the hammer B, with that angle being the circumferential length of the tooth 38. The teeth 40 are identical in configuration to the teeth 38, but their outside faces 50 form continuations of the side faces 36 on the annular body 30. Also the fillets 64 at the end faces 60 merge into the beveled surfaces 48 of the ring 42 instead of the beveled surfaces 46. The included angles a for all of the teeth 38 and 40 are identical and the sum of all these angles is less than 360°, for an angular spacing b exists between each tooth 38 and the adjacent tooth 40 around the entire periphery of the ring hammer B.

Considering the hammer B from a different perspective, it includes an annular body 30 having the teeth 38 and 40 projected from it in two rows and beveled surfaces 46 between the teeth 38 of the one row and more beveled surfaces 48 between the teeth 40 of the other row, with the bevels being such that the surfaces 46 and 48 taper downwardly toward the side faces 34 and 36, respectively, of the annular body 30. The beveled surfaces 46, in effect, elongate the teeth 38 and 40 without significantly reducing the strength of the teeth 38 and 40.

In use the ring hammers B revolve with the rotor 6 and are directed outwardly against the hammer pins 18 by the centrifugal force exerted on them. Material introduced into the inlet 4 drops downwardly into the paths of the ring hammers B and the hammers B impact against that material, driving it against the grinding plate 8 and thereafter drawing it along the grate bars 10. As the hammers B come against the material the teeth 38 and 40, or more specifically the cutting edges 58 and 62 on the teeth 38 and 40, tear into the material and reduce it to a smaller size. Should a hammer B encounter an oversize piece of material, it will to a limited measure retract into the space between adjacent spider arms 16. This, of course, lessens the chance of a tooth 38 or 40 breaking off. Aside from that, the reinforcing ring 42 strengthens teeth 38 and 40 on the ring hammer B and renders them less susceptible to breakage than teeth of conventional ring hammers. Inspite of the reinforcing ring 42, the teeth 38 and 40 for all intents and purposes have substantially the same depth as teeth on conventional ring hammers and therefore are just as effective insofar as cutting or reducing capabilities are concerned.

The ring hammer B is particularly suited for use in machines for reducing lump coal to smaller sizes without producing excessive fines and for reducing metal turnings to smaller sizes so that they are more easily shipped.

This invention is intended to cover all changes and modifications of the example of the invention herein chosen for purposes of the disclosure which do not constitute departures from the spirit and scope of the invention.

What is claimed is:

1. A ring hammer for a reducing machine, said ring hammer comprising an annular body having a center bore and side faces out of which the center bore opens, teeth projecting generally radially from the annular body and arranged in at least two circumferential rows, with the teeth of the one row being spaced axially from the teeth of the other row, the teeth of the one row further being offset circumferentially with respect to the teeth of the other row such that the teeth of the two rows alternate around the body; and a reinforcing ring extending around the body between the two rows of teeth and being joined to the annular body and the teeth of the two rows, the ring being substantially continuous between the two rows and further being extended into the regions between the teeth in each row, the ring in the regions between the teeth of each row having beveled surfaces which extend substantially the entire circumferential distance between successive teeth of the rows and taper downwardly toward the side faces of the body, all such that the teeth have greater depth adjacent to the side faces of the body than adjacent to the continuous portion of the ring.

2. A ring hammer according to claim 1 wherein the beveled surfaces of the reinforcing ring intersect the side faces of the annular body along arcuate margins that are substantially concentric to the axis of the annular body.

3. A ring hammer according to claim 1 wherein each tooth has parallel inside and outside faces with the inside faces being adjacent to the reinforcing ring.

4. A ring hammer according to claim 3 wherein the outside faces of the teeth in one row are continuous with the one side face of the annular body and the outside faces of the teeth in the other row are continuous with the other side face of the annular body.

5. A ring hammer according to claim 3 wherein each tooth further has an outer face and end faces which intersect the outer face at transverse cutting edges.

6. A ring hammer according to claim 5 wherein the outer faces of the teeth are arcuate and concentric about the axis of the annular body and the end faces are along radii emanating from the axis of the tooth.

7. A ring hammer according to claim 2 wherein the continuous portion of the reinforcing ring has a radially outwardly presented surface that is substantially cylindrical.

8. A ring hammer according to claim 1 wherein each tooth along its end faces merges with the adjacent beveled surfaces of the reinforcing ring at fillets.

9. A ring hammer according to claim 1 wherein the sum of the angles occupied by the teeth of the two rows around the periphery of the annular body is less than 360°, whereby spacing in the circumferential direction exists between the offset teeth of the two rows.

10. A ring hammer according to claim 1 wherein the side faces of the annular body are planar and parallel.

11. In a material reducing machine including a housing into which material that is to be reduced to a smaller size is introduced ad a rotor that revolves in the housing and has hammer pins thereon for retaining ring hammers on the rotor so that the ring hammers will impact against the material, an improved ring hammer comprising: an annular body having side faces and a center bore extended from one side face to the other and through which one of the hammer pins on the rotor extends, the center bore being concentric with respect to the axis of the annular body and being substantially larger in diameter than the hammer pin, so that the hammer pin is received loosely in the center bore; teeth formed integral with and projecting radially from the annular body, the teeth being arranged in two rows with the teeth of one row being spaced axially from the teeth of the other row, the teeth of the one row further being offset in the circumferential direction from the teeth of the other row such that the teeth of the two rows alternate around the body; and a reinforcing ring formed integral with the annular body and the teeth of both rows and extended around the body between the two rows of teeth where it has a substantially continuous outwardly presented surface, the reinforcing ring further being extended into the regions between the teeth in each row where it has beveled surfaces that taper downwardly away from the continuous outwardly presented surface, each beveled surface extending substantially the entire circumferential distance between the successive teeth of the row in which it is located and having an arcuate side margin that is substantially concentric to the axis of the annular body, the beveled surfaces of the reinforcing ring enabling the teeth to have greater depth adjacent to the side faces of the body than adjacent to the continuous outwardly presented surface of the ring.

12. The structure according to claim 11 wherein the outside faces of the teeth of the one row are continuous with the one side face of the annular body and the outside faces of the teeth of the other row are continuous with the other outside face of the annular body.

13. The structure according to claim 11 wherein the continuous outwardly presented surface of reinforcing ring is cylindrical.

14. The structure according to claim 11 wherein the arcuate side margins of the reinforcing ring are along the side faces of the annular body.

15. The structure according to claim 14 wherein the side faces of the annular body are planar and parallel.

16. A ring hammer for a material reducing machine, said ring hammer comprising: an annular body having side faces and a center bore extending from one side face to the other and teeth formed integral with and projecting radially from the annular body, the teeth being arranged in two rows around the annular body with the teeth of the one row being along one side face and the teeth of the other row being along the other side face, the teeth of the one row further being spaced axially from the teeth of the other row and offset in the circumferential direction with respect to the teeth in the other row, the annular body having a continuous outwardly presented surface between the spaced apart rows of teeth and beveled surfaces between successive teeth of each row, with the beveled surfaces tapering downwardly away from the continuous outwardly presented surface and toward the side faces and terminating at arcuate side edges that are substantially concentric to the axis of the annular body, each beveled surface extending substantially the entire circumferential distance between the two successive teeth that it separates, all such that the teeth have greater depth adjacent to the side faces of the annular body than adjacent to the continuous outwardly presented surface that extends between the two rows of teeth.

17. A ring hammer according to claim 16 wherein the side faces of the annular body are planar and parallel and the arcuate edges of the beveled surfaces are along the side faces of the annular body.

18. A ring hammer according to claim 17 wherein the continuous outwardly presented surface is cylindrical.

* * * * *